United States Patent [19]

Tone

[11] Patent Number: 4,534,568

[45] Date of Patent: Aug. 13, 1985

[54] ARCHERY ARROW WITH FREELY ROTATIONAL BROAD BLADE ARROWHEAD TO AVOID WINDPLANING

[76] Inventor: Richard D. Tone, 1849 W. Third Pl., Mesa, Ariz. 85201

[21] Appl. No.: 537,587

[22] Filed: Sep. 30, 1983

Related U.S. Application Data

[63] Continuation-in-part of Ser. No. 319,186, Nov. 9, 1981, abandoned.

[51] Int. Cl.[3] ..... F41B 5/02

[52] U.S. Cl. ..... 273/421; 403/164

[58] Field of Search ..... 273/419–423; 403/164, 165; 384/280, 281, 276, 283, 300, 297, DIG. 9

[56] References Cited

U.S. PATENT DOCUMENTS

| | | | |
|---|---|---|---|
| 434,262 | 8/1890 | Freeman | 403/165 X |
| 434,295 | 8/1890 | Richardi | 403/165 X |
| 515,023 | 2/1894 | Salathe | 403/164 X |
| 636,148 | 10/1899 | Kenyon | 403/165 X |
| 1,659,576 | 2/1928 | Brady et al. | 403/165 X |
| 3,099,895 | 8/1963 | Beebe | 403/164 X |
| 3,582,157 | 6/1971 | Hammon | 384/300 X |
| 3,582,166 | 6/1971 | Reising | 384/300 X |
| 3,641,990 | 2/1972 | Kinnersly | 308/DIG. 9 X |
| 3,865,437 | 2/1975 | Crosby | 403/165 X |
| 3,910,579 | 10/1975 | Sprandel | 273/421 X |
| 3,999,874 | 12/1976 | George et al. | 403/165 |
| 4,172,622 | 10/1979 | Baker et al. | 384/300 |
| 4,200,541 | 4/1980 | Kinner et al. | 308/DIG. 9 |

*Primary Examiner*—Paul E. Shapiro

*Attorney, Agent, or Firm*—Cahill, Sutton & Thomas

[57] ABSTRACT

An archery arrow includes a tubular aluminum housing attached in an opening in the leading end of an aluminum arrow shaft. A hard insert with a plurality of thin, circular, annular, peripheral ridges is rotatably disposed in the housing, the smooth interior surface of the housing and the smooth surfaces of the ridges providing a very low friction bearing. The insert includes a threaded opening for receiving the threaded end of a stud of a broad blade arrowhead. During flight, the shaft spins rapidly due to offset fletching on the trailing end of the arrow, but the broad blade arrowhead spins relatively little, thereby avoiding windplaning of the arrow, and also substantially increasing penetration of the arrowhead into a target. In one embodiment, the blades of arrowheads are offset in a direction opposite to the offset of the fletching to cause the arrowhead to rotate rapidly in the direction opposite to the direction of rotation of the arrowhead shaft during flight, resulting in further decreased windplaning and increased arrow stability and accuracy.

15 Claims, 20 Drawing Figures

1A
5
5A
5B
52
3
53
43
43A
41
5C 49
25
13
23
54
37

56
35
55
69
9B

43AA

43A 63
64
65
67
66
68

70
59
60
61
62
58
1
57

ARCHERY ARROW WITH FREELY ROTATIONAL BROAD BLADE ARROWHEAD TO AVOID WINDPLANING

RELATED APPLICATIONS

This application is a continuation-in-part of my copending application entitled "ARCHERY ARROW WITH FREELY ROTATIONAL BROAD BLADE ARROWHEAD TO AVOID WINDPLANING", Ser. No. 319,186 filed Nov. 9, 1981, now abandoned.

BACKGROUND OF THE INVENTION

The invention relates to archery arrows, and more particularly, to inserts for aluminum arrow shafts to receive threaded studs of removable arrowheads, and still more particularly to archery broad blade arrowhead attachment devices that avoid windplaning of arrows in flight.

Modern archery arrows are frequently made of lightweight aluminum or other suitable metal tubing material. Slightly offset feathers or fletching are provided on the trailing end of the shaft to cause rapid spinning of the shaft during flight, as this is known to improve the range, stability and accuracy of arrows. Various kinds of arrowheads are used, including target arrows which have no blades, and various kinds of hunting arrows, which have broad blades. Since the aluminum shafts are expensive, removable arrowheads with threaded studs have been devised and are quite popular. The leading ends of arrow shafts have inserts therein with threaded openings to receive the threaded studs, so an archer can remove a damaged arrowhead and replace it without incurring the expense of buying an entire new arrow, or he can exchange one type of tip for another type, thereby reducing the number of arrows of different types that he needs to own.

Target arrowheads are very streamlined since they have no blades, and do not deleteriously affect the flight of a rapidly spinning arrow. However, broad blade hunting arrowheads have a singificant amount of blade area which interacts with the air currents created while the rapidly spinning arrow is in flight. This effect, referred to as "windplaning", causes an undesirable loss of range and accuracy of the arrow. It should be noted that the above-mentioned interaction of the blade area is aggravated by the manner in which an arrow is propelled by a bow. The shaft of an arrow is always somewhat flexible, and will tend to flex in an oscillatory manner during flight. This oscillatory flexing is initiated by the way that the bowstring is released. As the archer releases the bowstring, it rolls sideways and over the ends of his fingers, thereby also displacing the nock of the arrow sideways. As the bowstring propels the arrow forward, the bowstring naturally also tends to move sideways back to its original plane, but "overshoots" due to the mass of the string and the rear end of the arrow. The handle of the bow, against which the arrow rests, is rigid, so the oscillatory flexing of the arrow shaft is thereby initiated. A large amount of spin of the arrow during flight will tend to reduce the oscillatory flexing, but interaction between air currents, a typical broad blade arrowhead, and feathers or plastic vanes on a shaft can tend to reduce such spinning of the shaft and also increase the amount of windplaning.

Certain prior art devices are known which provide a means for rotationally connecting a broad blade hunting arrowhead to the leading end of a shaft. For example, U.S. Pat. No. 3,910,579 by Sprandell discloses such a device and teaches that the device disclosed therein causes the arrow shaft to rotate at a different rate than the broad blade arrowhead, resulting in truer flight, and prevents the arrowhead from turning at the time that it penetrates the flesh of an animal, thereby resulting in greater penetration of the flesh without torquing or binding of the head or excessive tearing of the flesh. U.S. Pat. No. 4,175,749 by Simo discloses a broad blade arrowhead which rotates with the arrow shaft while in flight, but upon initial penetration of target material, the broad blade portion ceases to rotate relative to the arrow shaft and nose piece to thereby lessen the loss of forward penetration energy from the arrow so that a greater quantity of the arrow's energy is available for forward penetration into the target material.

Unfortunately, none of the above structures provide the low amount of frictional resistance to rotation of the arrowhead needed to adequately reduce the amount of windplaning caused by a broad blade arrowhead.

Therefore, it is an object of the invention to provide an arrowhead, especially a broad blade hunting arrowhead, which rotates much more freely relative to an arrow shaft than prior art devices.

When hunting arrows miss their targets, either targets used for target practice or prey during hunting, the arrowheads often are thrust into dirt or are otherwise exposed. Minute particles of dirt, dust, etc. which enter into the bearing mechanisms of prior rotational arrowhead devices, further increasing the friction of rotation, further preventing them from rotating freely enough to effectively reduce windplaning of the arrow. None of the prior rotational arrowhead devices can be easily disassembled and cleaned.

Therefore, it is an object of the invention to provide an extremely low friction rotational arrowhead which is easily disassembled, cleaned, and re-assembled.

Up to now, no one has provided a broad blade arrowhead that adequately, and reliably avoids the effects of windplaning.

Accordingly, it is an object of the invention to provide an improved archery arrow that avoids windplaning when a broad blade arrowhead is used.

It is another object of the invention to provide a means of attaching a broad blade arrowhead to an arrow shaft in a manner that avoids windplaning of the arrow during flight.

It has been found that typical broad blade hunting arrowheads do not penetrate and animal target nearly as much when the arrow shaft and arrowhead thereon are spinning at the instant the arrowhead strikes the animal as is the case if the arrow shaft and arrowhead are not spinning. This is highly undesirable, since it results in animals being wounded but not quickly killed. Frequently, the animals run away and die slowly and painfully. The above-mentioned loss of accuracy due to windplaning of arrows with broad blade hunting arrowheads also results in animals being wounded but not quickly killed.

Accordingly, it is another object of the invention to provide an improved, accurate broad blade archery arrow that both avoids windplaning and penetrates deeply into an animal target.

It is another object of the invention to provide an improved means of attaching a broad blade arrowhead to an arrow shaft to both avoid windplaning of the arrow during flight and to provide improved penetration into a target.

SUMMARY OF THE INVENTION

Briefly described, and in accordance with one embodiment thereof, the invention provides a low friction, rotational element connecting a broad blade arrowhead to the leading end of an arrow shaft, the rotational connecting element preventing excessive spinning of the broad blade arrowhead as the shaft of the arrow spins rapidly during flight, thereby avoiding windplaning. In the described embodiment of the invention, a cylindrical tubular aluminum housing is attached as an insert in the leading end of an aluminum arrow shaft. A cylindrical inner surface of the housing is extremely smooth, providing a low friction bearing surface. A hard plastic or metal insert having an enlarged flange on its leading end includes an elongated body and at least two thin, enlarged ridges disposed on the body to provide bearing surfaces that slidably engage the low friction bearing surfaces of the housing. A slotted, enlarged trailing portion of the insert extends out of the trailing end of the housing to facilitate insertion of the insert through the housing and removal of the insert from the housing, thereby providing a snap-on, snap-off retainer. An axial hole in the insert is threaded to receive a threaded stud of a broad blade arrowhead. The amount of friction between the insert and the housing is so low that the broad blade arrowhead rotates substantially less than the spinning shaft of the arrow during flight and prevents windplaning of the arrow. The broad blade arrowhead can be removed, if desired, and a target arrow with a threaded stud can be used instead.

In one embodiment of the invention, the inner surface of the tubular aluminum housing is coated with molybdenum disulfide or Teflon to reduce friction thereof, and the outer surface of the insert can be coated with the same material to reduce friction. In another embodiment of the invention, offset or spiral blades are provided on the broad blade arrowhead to cause rapid spinning of the arrowhead in the direction opposite to the direction of rotation of the arrow shaft caused by the fletching on the trailing end of the arrow during flight. The resulting increased rotational rate of this broad blade arrowhead provides increased stability and has been found to reduce the amount of windplaning and increase the accuracy of the hunting arrow even more than simply using the low friction insert and aluminum housing alone in conjunction with a broad blade arrowhead. The snap-on retainer also functions as a snap-off retainer, allowing removal of the insert so that it can be cleaned in the event that minute particles of dust or grit enter into the bearing and increase friction which impedes rotation of the insert. In one embodiment of the invention, offset or spiral fins are provided on a target arrowhead, not to eliminate windplaning, but to cause rapid rotation of the target arrowhead relative to rotation of the shaft due to offset fletching thereof and in the opposite direction thereto to provide increased stability due to gyroscopic action. In another embodiment, an airfoil configuration of the blades accomplishes the desired rotation of the arrowhead in the desired direction.

In one embodiment of the invention, the front peripheral ridge of the rotational insert engages an outwardly flared surface of the mouth portion of the insert receiving hole of the housing to minimize rotational friction, limit movement of the insert into the housing, and precisely center the insert in the housing during flight of the arrow. In one embodiment, a narrowed stud extending from the trailing end of the insert has an enlarged threaded end portion that is threaded completely through a mating threaded hole in the trailing end of the housing to retain the insert while allowing free rotation thereof relative to the housing.

DESCRIPTION OF THE INVENTION

Figure 1:
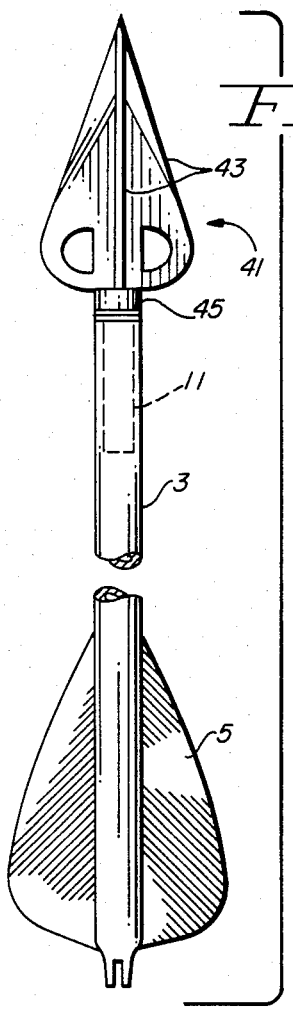
FIG. 1 is a partial elevational view of an arrow in accordance with the invention.

Referring now to the drawings, archery arrow 1 includes a tubular aluminum shaft of the type conventionally used for high quality, modern, archery arrows. A plurality of slightly offset feathered guides or vanes 5, referred to as fletching, are attached to the trailing end of the arrow adjacent to the nock thereof, the amount of offset of the feathers being selected to cause a satisfactorily high rate of spinning of the arrow during flight, as this is known to improve the range and accuracy of an arrow.

In accordance with the present invention, a low friction rotational arrowhead connector 11 is disposed in the open end 7 of the tubular arrow shaft 3. Rotational arrowhead connector 11 includes a cylindrical aluminum housing 13 having an enlarged flange or ridge 17 at its leading end. Three shallow grooves 19 are provided at approximately equally spaced locations around the outside walls of housing 13 to improve the attachment of housing 13 in open end 7 of shaft 3. The inside surface of housing 13, designated by reference numeral 21 is very smooth, and provides a very low friction bearing surface. The bottom or trailing portion of housing 13 is slightly tapered, and its inside diameter is reduced, as indicated by reference numeral 23.

Housing 13 can be permanently installed in the open end 7 of arrow shaft 3 by means of suitable permanent glue, such as epoxy glue or the like.

As housing 13 is inserted into open end 7 of arrow shaft 3, enlarged flange 17 limits the distance of insertion.

Rotational arrowhead connector 11 includes an insert 25, which is preferably composed of metal or hard plastic, such as Nylatron material. Insert 25 has an enlarged flange 29 at its leading end, an elongated cylindrical body portion 27, and a plurality of spaced thin, ridges 31 disposed along the elongated body section 27. The outer surfaces of ridges 31 can be cylindrical, or transversely curved and provide low friction bearing surfaces that slide along the low friction bearing surface 21 of housing 13. A hole 16 (FIG. 2) is included in the outer surface of enlarged flange 29 for receiving a spanner wrench to effect tightening of or removal of threaded stud 49 from insert 25. Alternatively, enlarged flange 29 can have flat surfaces for receiving an ordinary wrench.

At the trailing end of insert 25, a slotted snap-in, snap-out flange section includes a slot 39, and a relatively narrow neck portion 35 and relatively enlarged, tapered end portions 37. The slot 39 is sufficiently large that the enlarged end portions 37 can be squeezed together to allow them to pass through reduced diameter opening 23 of housing 13 and then expand to provide a snap-in retaining clip that prevents insert 25 from falling out of housing 11 but does not interfere with free rotation of insert 25 in housing 13 because an adequate amount of tolerance is allowed so that the inner surface portion 23 of housing 13 does not touch the outer surface of neck portion 35 as insert 25 rotates in housing 13.

A coaxial hole extending through insert 25 has a threaded portion 30 for receiving the threads 49 of the stud of broad blade arrowhead 43.

Arrowhead 43 is a removable arrowhead having a stud 47 with a lower threaded portion 49 that fits into commercially available arrowhead fasteners that are commonly attached in the open ends of arrow shafts. The broad blade sharpened portion 43 of arrowhead 41 is connected by element 45 to the upper portion of stud 47.

In the above-described embodiment of the invention, the outside diameter of housing 13 is approximately 0.31 inches, the outside diameter and thickness of flange 17 are approximately 0.34 inches and 0.002 inches, respectively. The grooves 19 are approximately 0.25 inches wide and 0.002 inches deep. The inside diameter of upper portion 21 of housing 13 is b 0.25 inches, and the inside diameter of the lower portion 23 is 0.19 inches. The length of housing 13 is 1.12 inches.

The length of insert 25 is 1.28 inches, the outside diameter of the body portion 27 is 0.24 inches, the outside diameter and thickness of upper flange portion 29 are 0.34 inches and 0.004 inches, respectively. The three bearing ridges 31 are spaced 0.36 inches apart, and each have an outside diameter of 0.26 inches and a thickness of 0.004 inches. The nominal tolerance between the bearing surfaces of bearing ridges 31 and the inside diameter of upper portion 21 of housing 13 is approximately 0.001 inches. The above dimensions, of course, are merely exemplary.

The above-described rotational arrowhead connector will allow the arrow shaft to spin rapidly during flight while the broad blade arrowhead connected thereto rotates relatively little, thereby avoiding windplaning, resulting in increased accuracy and range, and also allowing improved penetration of the broad blade arrowhead.

For a wood arrow shaft, or any other solid (non-tubular) shaft material, a tubular sleeve can be attached to the leading end of the shaft so that it extends beyond the solid shaft material to receive the rotational arrowhead connector 11.

It may be desirable to provide "snap-in, snap-out" capability for insert 25. This can be accomplished in a variety of ways. For example, the enlarged end portion 37 of insert 25 can be provided with a beveled edge on its upper shoulder, so that if a sufficient upward pulling force is applied to insert 25, it can be conveniently withdrawn from housing 13. Alternately, instead of providing enlarged end portion 37 as an integral part of insert 25, a flexible "O" ring could be provided in a groove in the lower end portion of insert 25. The outside diameter of the "O" ring would, of course, be slightly larger than the inside diameter of opening 23.

Figures 5A, 5B, 5C, 6, 7, 8, 9A, 9B, 10A, 10B, 11, 12:
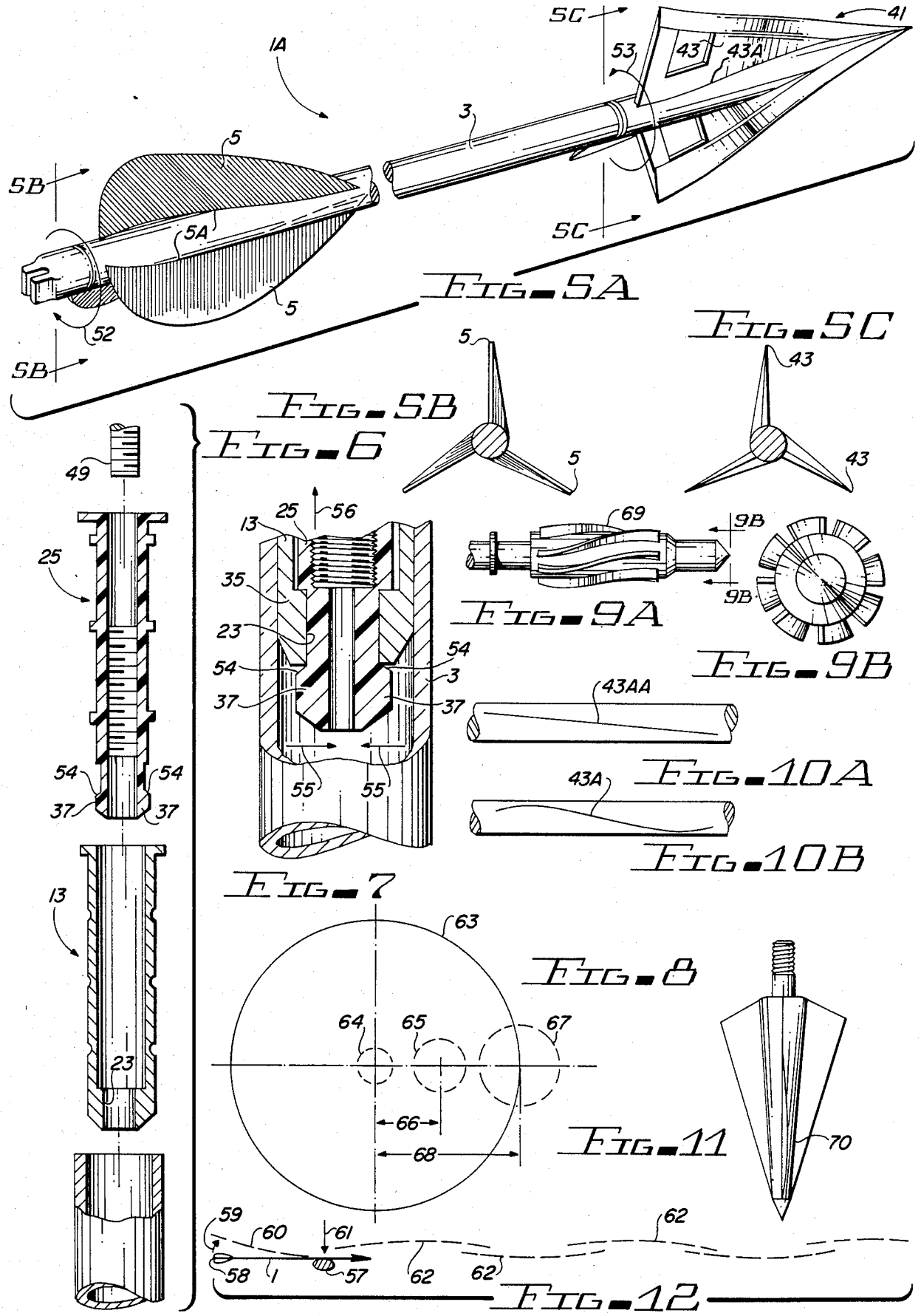
FIG. 5A is a partial perspective view illustrating an arrow with spiral fletching on its trailing end, a broad blade arrowhead attached by means of a rotatable insert to the leading end of the arrow shaft and having spiral offset so that wind forces cause the arrowhead to rotate in the direction opposite to the direction in which the shaft is caused to rotate by the fletching during flight of the arrow.
FIG. 5B is a section view taken along section line 5B—5B of FIG. 5A illustrating the direction of offset of the fletching.
FIG. 5C is a section view taken along section line 5C—5C of FIG. 5A indicating the direction of offset of the arrowhead.
FIG. 6 is a partial exploded section view similar to that shown in FIG. 3, emphasizing the snap-in, snap-out capability of the rotational insert.
FIG. 7 is a partial section view illustrating the rotational insert completely inserted into the housing shown in FIG. 6.
FIG. 8 is a diagram of a target, and groupings of "hits" which illustrate the accuracy of the different embodiments of the invention based on experimental results.
FIG. 9A is a plan view illustrating spiral fins on a target arrowhead.
FIG. 9B is a front end view of the arrowhead of FIG. 9A.
FIG. 10A is a diagram useful in illustrating a straight slot for attachment of a curved blade into a broad blade arrowhead.
FIG. 10B is a diagram illustrating a helical slot into which a helical blade can be inserted into a broad blade arrowhead.
FIG. 11 is a diagram illustrating a blade having an air foil configuration that causes it to rotate in a direction opposite to the rotation of the arrow shaft during flight.
FIG. 12 is a diagram useful in explaining windplaning of an arrow.

Referring now to FIG. 5A, arrow shaft 3 is provided with spiral fletching or vanes 5 on its trailing end. Note the spiral lines 5A at the base of the individual vanes. The rotation caused by spiral fletching 5 as arrow 1A travels in flight is clockwise, as indicated by arrow 52.

In accordance with another embodiment of the present invention, the broad blade arrowhead 41 has its vanes offset in a sense opposed to the offset of spiral fletching 5, so that broad blade arrowhead 41 rotates counter clockwise in the direction of arrow 53 as arrow 1A travels in flight. Note that in FIG. 5A the same reference numerals are used to designate similar parts of arrow 1 of FIG. 1. The fact that the sense of the offset of the blades of broad blade arrowhead 41 is opposite to that of the spiral fletching 5 thereof can be easily seen by looking at the spiral line 43A designating the intersection of blade 43 with the shank of arrowhead 41 and comparing it to lines 5A where the fletching 5 meets the arrow shaft 3. The opposite sense of the offset of fletching 5 and arrowhead blades 43 also can be readily seen from the section views thereof in FIGS. 5B and 5C, respectively.

Figure 3:
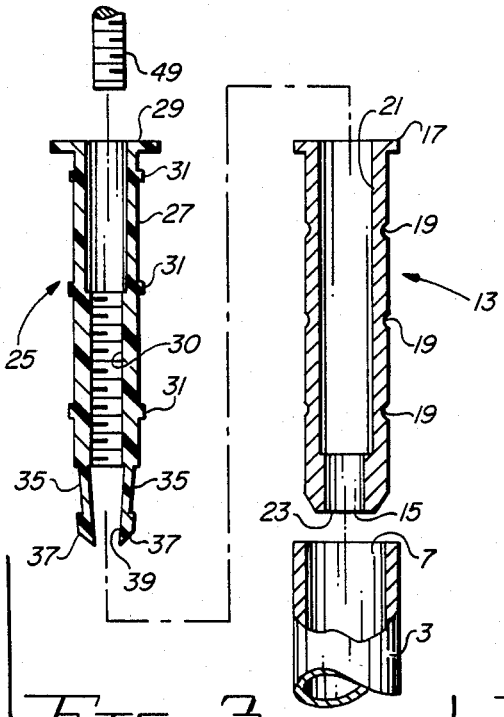
FIG. 3 is a section view taken along section line 3—3 of FIG. 2.
Figure 4:
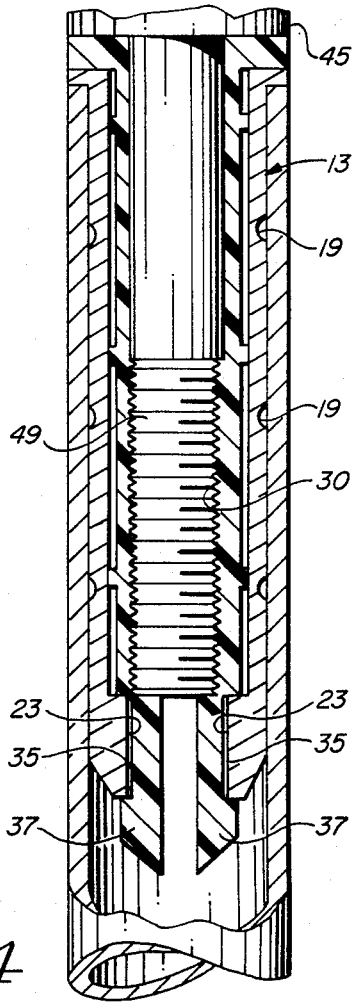
FIG. 4 is a section view showing the rotatable arrowhead connecting device.

The broad blade arrowhead 41 is connected by means of a threaded stud 49 to a plastic or metal insert 25 which can be similar to that shown in FIG. 3 to provide a very low friction, rotatable bearing which allows broad blade arrowhead 41 in FIG. 5A to freely rotate counterclockwise in the direction of arrow 53 while the shank 3 of arrow 1A rotates clockwise in the direction of arrow 52. The only difference between the insert 25 as shown in FIG. 6 from that shown in FIG. 3 is the provision of a definitely inclined slope 54 on the upper edges of the end portion 37 thereof. It will be recalled that it was previously explained with reference to FIG. 3 that the lower edge of end portions 37 are tapered inward to cause end portions 37 to be squeezed together as they are forced through opening 23 in the bottom of aluminum housing 13.

The sloped upper surfaces 54 of end portions 37 readily provide the above-mentioned "snap-out" feature, as can be best seen in FIG. 7. In FIG. 7, it can be readily seen that the sloped surfaces 54 will cause the end portions 37 to squeeze together in the direction of arrow 55 when plastic insert 56 (with broad blade arrowhead 41 rigidly attached thereto) is pulled out of aluminum housing 13 in direction of arrow 56. My experiments have shown that this capability of being easily inserted into aluminum housing 13 and removed from aluminum housing 13 is very important to the present invention. The plastic inserts 25 initially, when they are brand new and are inserted into the aluminum housings 13 in the end of an arrow shaft such as 3, have an extremely low rotational friction. However, repetitive experiments by myself and other highly qualified archers testing the accuracy of various arrows that are equipped with standard broad blade arrowheads which do not rotate, broad blade arrowheads which rotate only slightly relative to a fletched arrow shaft, non-offset broad blade arrowheads such as the one shown in FIGS. 1 and 2 attached to the insert 25 of the present invention, and offset broad blade arrowheads such as 41 of FIG. 5A which rotate in the direction opposite to the fletched arrow shaft during flight, have led me to the conclusion that even minute amounts of dust or grit between insert 25 and housing 13 increase the friction between insert 25 and aluminum housing 13 enough to cause a great loss in accuracy.

To better understand my experiments, it would be helpful to first refer to FIG. 12 for an explanation of what windplaning of an arrow actually looks like to a skilled observer. In FIG. 12, reference numeral 57 designates the handle of a bow. Reference numeral 1 designates an arrow. Reference numeral 58 designates the initial point of the nock of the trailing end of the arrow when the bow string is drawn to its full extent. Reference numeral 59 designates sideways movement of the nock of the arrow and the bow string that inevitably occurs as the bow string rolls off the end of the archer's fingers as the arrow is released. Dotted line 60 designates the position of the arrow 1 at this instant. As the bow string thrusts the arrow forward, it can be seen that the arrow is no longer oriented straight at the target. In fact, the arrow is flexed somewhat, as it is thrust forward by the bow string. In fact, the side of the arrow is forced strongly in the direction 61 against the side of the bow handle or window 57. This causes the flexing of the arrow, which, in turn, gives rise to oscillation of the arrow, indicated by reference numeral 62, as the arrow flys forward. Thus, the arrowhead is not always pointing exactly straight ahead during flight. Therefore, the effect of the air passing over plane surfaces of broad blade arrowheads as the arrow flies through the air are varied and are amplified as the orientation of the arrowhead varies as the shaft flexes in an oscillating manner during flight. This causes windplaning which can be readily detected by skilled observers.

My experiments have shown that even minute amounts of "wobble" in the orientation of broad blade arrowheads due merely to the tolerance between the above-described inserts 25 and housings 13 can affect the flight aerodynamics of the broad blade arrowhead enough to significantly reduce the accuracy of an arrow. The subsequently described embodiment of the invention shown in FIGS. 14A and 14B effectively overcomes this problem.

My experiments have also shown that the amount of offset of the above-mentioned offset vanes should be kept below a certain amount which, if exceeded, will cause too rapid rotation of the arrowhead that causes a sharp increase in the amount of windplaning.

Next, the effects of windplaning on different kinds of arrows are described with reference to FIG. 8, wherein reference numeral 63 represents a target that is three feet in diameter. Reference numeral 64 designates a three inch diameter bullseye of target 63. It represents a "grouping" of hits which a highly skilled archer can achieve shooting high quality field or practice arrows (which do not have blades) with a 65 pound pull compound hunting bow at a range of 75 feet. In my experimental results, reference numeral 65 designates a seven inch diameter grouping of broad head hunting arrows having a "divergence" indicated by reference numeral 66 of six to eight inches. Reference numeral 67 represents another seven inch to fourteen inch diameter grouping of broad blade hunting arrows having a divergence represented by arrow 68 of twelve to eighteen inches.

Those skilled in the art will realize that meaningful testing of the accuracy of arrows with rigidly attached broad blade arrowheads must be done with numerous shots of identical arrows, with each broad blade arrowhead rotationally oriented or "indexed" in exactly the same way. Otherwise, the divergence mentioned above will vary markedly.

In my experiments involving 50 shots with each type of arrow, at a distance of 75 feet with a 65 pound compound hunting bow, and using four-blade type broad blade arrowheads without any type of rotational connection to the shaft of the arrow, seven inch diameter groups with divergences of seven to fourteen inches are consistently obtained by skilled archers. However if, the same broad blade arrowheads are attached to inserts such as 25 described herein, which are then inserted into aluminum housing such as 13, then a three to six inch diameter group such as 65 with a divergence 66 of approximately six to eight inches is obtained. Finally, if the reverse offset broad blade arrowheads such as 41 in FIG. 5A which rotate in the direction opposite to shaft 3 during flight are used instead, then a grouping three inches in diameter with a divergence of zero to three inches is obtained, which indicates that in this case, windplaning is essentially eliminated.

However, my experiments have shown that the results of repeated shots of the same arrow are not consistent, because minute amounts of dust or grit interfere with the free rotation of inserts 25 relative to aluminum housings 13 and arrow shafts 3. However, if an insert 25 is periodically removed and carefully cleaned and then reinserted after each shot, then consistent accurracy will be obtained.

It should be appreciated that the spiral offset shown for blades 43 of broad blade arrowhead 41 in FIG. 5A can be obtained in other ways than providing a spiral interface between the shank of arrowhead 41 and the base of the blade as represented by line 43A in FIG. 5A. Instead, a straight line, such as 43A in FIG. 10A, could be provided instead of the spiral connection 43A shown in FIG. 10B.

Furthermore, there may be instances in which spiral or offset fins such as 69 shown on a target arrow or field arrow in FIGS. 9A and 9B could be provided to provide reverse rotation of the field arrowhead. The reverse rotation of the arrowhead relative to the shaft can increase gyroscopic action of the arrow during flight and lead to improved stabilization.

As indicated in FIG. 11, the reverse direction of rotation of a broad blade arrowhead 41 can be obtained by providing an airfoil shaped configuration as indicated by reference numeral 70 on each of the blades, causing rotation in the direction of arrow 53, instead of physically offsetting the blades relative to the axis of the arrowhead.

Figure 13A:
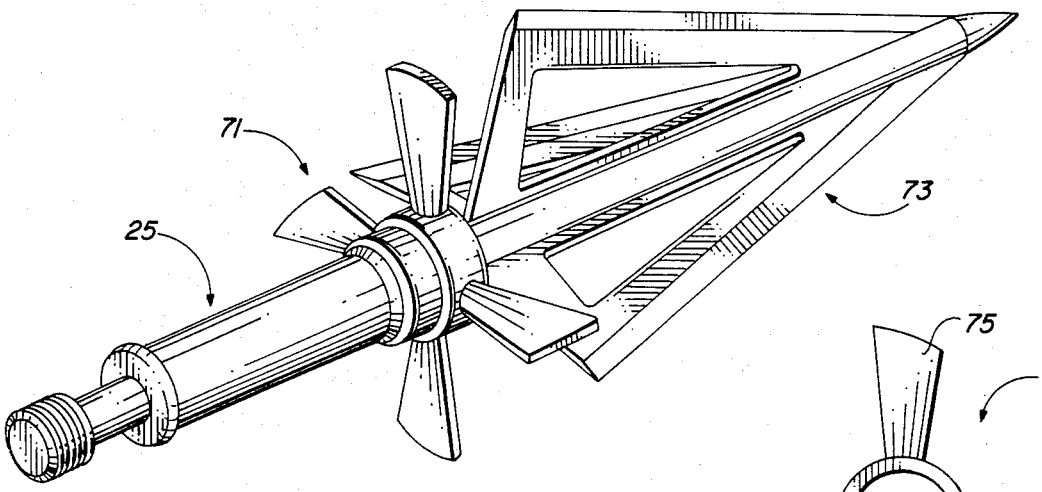
FIG. 13A is a perspective view of a broad blade arrowhead with flat blades and a propeller disposed between the arrowhead and a rotational arrowhead connector of the invention for causing the arrowhead to spin during flight in the opposite direction from the direction which offset fletching causes the shaft to spin during flight.
Figure 13B:
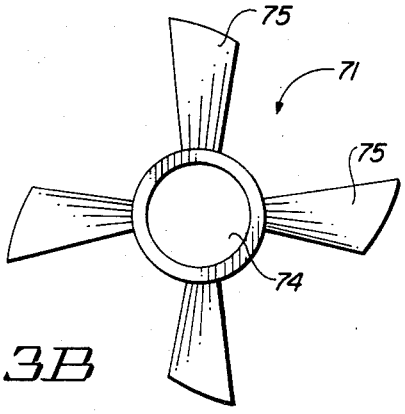
FIG. 13B is a plan view of the propeller included in FIG. 13A.

Furthermore, rotation of the broad blade arrowhead can be achieved by placing a propeller-like "wing-ring" between the back edge of the arrowhead and the leading end of insert 25, as shown in FIG. 13A. More specifically, in FIG. 13A, propeller-like wing ring 71 is disposed between the back end of conventional flat bladed arrowhead 73 and rotational arrowhead connector 11. FIG. 13B illustrates a plan view of propeller 71 wherein it can be seen that it has a center hole 74 through which the threaded stud 49 of arrowhead 73 (see FIG. 2) extends into the threaded hole at the front end of insert 25. Four propeller blades 75 extend outwardly from the hub of propeller 74 to cause flat blade arrowhead 73 to rotate in the direction opposite to the direction of the arrow shaft.

Figure 14A:
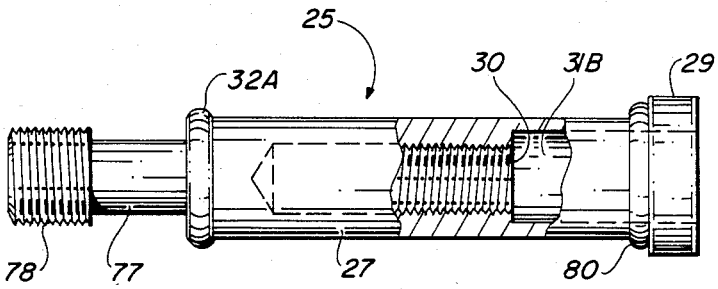
FIG. 14A is a side view of the rotational insert portion of an alternate rotational arrowhead connector of the invention.
Figure 14B:
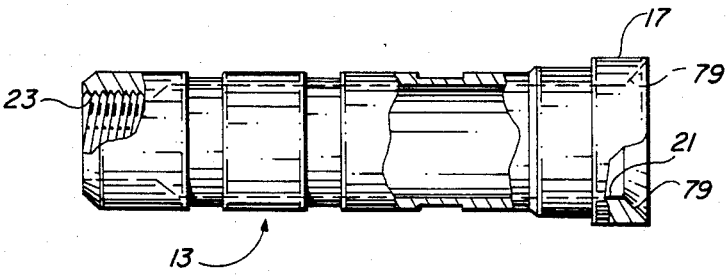
FIG. 14B is a side view of the insert receiving or housing portion of the rotational arrowhead connector which receives the insert portion of FIG. 14A.

Referring now to FIGS. 14A and 14B, yet another embodiment of the invention is shown. Where applicable, the same reference numerals are used as in FIGS. 2, 3, 6, and 7 to designate corresponding parts. Referring now to FIG. 14A, insert 25 is made of aluminum, rather than hard plastic as previously described. As before, the threaded hole 30 is provided in the right hand end of insert 25 for receiving the threaded stud such as 49 (FIG. 2) of a typical broad blade arrowhead. A cylindrical flange 29 is provided at the left end of insert 25. The main body portion 27 of insert 25 is precisely cylindrical.

Figure 2:
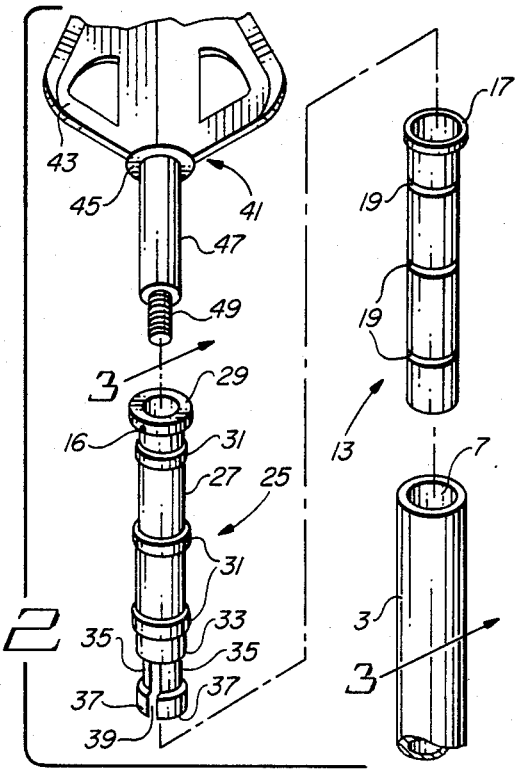
FIG. 2 is a partial exploded perspective view of the arrow of FIG. 1 showing a device rotatably connecting the broad blade arrowhead to the shaft of the arrow.

Only two thin cylindrical ridges 31A and 31B are provided circumferentially on the left and right ends of cylindrical main body 27, respectively. These ridges are not cylindrical, but instead have transversely radially curved outer surfaces. At the left end of cylindrical body portion 27, a reduced diameter stud portion 77 has an enlarged threaded end portion 78 which is screwed clockwise into mating threads on the inner surface 23 on the left end of the hole extending longitudinally through aluminum housing 13 shown in FIG. 13B assuming that the arrow fletching 5 is offset so that the arrow rotates counterclockwise during flight as seen from the target). The inner surface 21 of housing 13 is precisely cylindrical, as previously. Flange 17 is provided at the right hand end of housing 13, as before to limit the extent of housing 13 into the open end 7 of arrow shaft 3 (FIG. 2).

However, the extreme right end of the mouth of the opening extending longitudinally through housing 13 is widened, or outwardly flared, having a generally frusto-conically, outwardly flared portion designated by reference numeral 79 in FIG. 14A. The angle of this outward flaring portion is approximately 45° relative to the longitudinal axis of housing 25. The dimensions of flared surface 70 are such that the transversely curved right hand ridge 31B of insert 25 abuts and rotates on the flared surface 79. The above edge of ridge 31B is curved. The radius of curvature indicated by reference numeral 80 is such that the rounded edge of ridge 31B contacts the flared or sloped mouth portion 79 of opening 21 along a circle that lies roughly half way between the right and left edges of flared surface 79.

I have found that this structure has two very significant advantages. The first advantage is that it significantly reduces rotational friction between insert 25 and housing 13. The second reason is that during flight, the broad blade arrowhead is forced toward the arrow shaft by the wind forces, thereby causing ridge 31B to be urged against the outwardly flared surface 79, causing insert 25, and hence the arrowhead, to be perfectly centered within cylindrical housing 13. I was very surprised to discover that this causes a significant reduction in the amount of windplaning over the previous rotational arrowhead connectors because the tolerance between the previous inserts and housings thereof is very small.

It should be appreciated that when insert 25 is threaded all the way into housing 13, the threaded portion 78 extends to the left beyond the threaded surface 23 of housing 13, so that insert 25 can rotate freely, the only frictional contact between insert 25 and housing 13 then being on the maximum diameter portions of rear ridge 31A and the circle of contact between the flared mouth opening 79 and front ridge 31B.

While the invention has been described with reference to a particular embodiment thereof, those skilled in the art will be able to make various modifications to the described embodiment of the invention without departing from the true spirit and scope thereof. For example, different numbers of bearing ridges such as 31 could be provided. The entire insert 25 could be made an integral part of the arrowhead. Different types of snap-in, snap-out, screw-in or screw-out retaining means could be provided.

I claim:

1. An improved arrowhead connector for rotationally connecting an arrowhead to the leading end of the shaft of an archery arrow, said arrowhead connector comprising in combination:

(a) insert means for rigid connection to said broad blade arrowhead to rotationally support said arrowhead on said leading end of said shaft, said insert means having an outer surface;

(b) insert receiving means rigidly attached to said leading end of said shaft and having a cylindrical hole therein for receiving and rotationally supporting said insert means with sufficiently low friction to allow sufficiently rapid relative rotation between said arrowhead and said shaft to substantially prevent windplaning of said arrow, said insert means having a generally cylindrical inner surface;

(c) a plurality of relatively thin, substantially spaced, circumferential, smooth surfaced, circular ridges disposed on said outer surface for making very low friction sliding contact with said cylindrical inner surface to allow said rapid relative rotation;

(d) retaining means attached to said insert means for effectuating rapid insertion of said insert into said insert receiving means, retaining of said insert means in free rotational relationship with said insert receiving means, and effectuating rapid removal of said insert from said insert receiving means to allow rapid removal and cleaning of said ridges and rapid reinstallation of said insert means in said insert receiving means; and (e) forward ridges disposed at a forward end portion of said insert means and having a precisely rounded edge and a diameter slightly larger than the diameter of said generally cylindrical hole, wherein said cylindrical hole has an outwardly flared, low friction mouth portion, said rounded edge of said forward ridge precisely, rotationally abutting an outwardly flared surface of said mouth portion.

2. The improved arrowhead connector of claim 1 wherein said arrowhead is a broad blade hunting arrowhead.

3. The improved arrowhead connector of claim 1 whereln said insert means is composed of metal.

4. The improved arrowhead connector of claim 1 wherein said insert receiving means includes a cylindrical metal housing inserted into an open end of said leading end of said shaft.

5. The improved arrowhead connector of claim 4 wherein said insert means has at least two of said ridges disposed thereon.

6. The improved arrowhead connector of claim 1 wherein said ridges are coated with molybdenum disulfide to reduce friction thereof.

7. The improved arrowhead connector of claim 1 wherein said ridges are coated with teflon to reduction friction thereof.

8. The improved arrowhead connector of claim 1 wherein said retaining means includes a stud attached to one end of said insert means, said stud having an enlarged threaded end portion and a narrowed shaft portion attached to that end of said insert means, wherein said insert receiving means includes a threaded hole at one end thereof for rcceiving threads of said enlarged threaded end portion, said narrowed shaft portion being sufficiently long that said enlarged threaded end portion can be threaded entirely through said threaded hole so that then said insert means rotates freely relative to said insert receiving means.

9. Archery apparatus including an arrowhead and a connector for rotationally connecting said arrowhead to the leading end of the shaft of an archery arrow, said arrow including offset fletching on the trailing end of said shaft for causing said shaft to rapidly rotate about its axis in a first direction during flight of said arrow, said archery apparatus comprising in combination:

(a) insert means for rigid connection to said arrowhead to rotationally support said arrowhead on said leading end of said shaft, said insert means having an outer surface;

(b) insert receiving means rigidly attached to said leading end of said shaft and having a cylindrical hole therein for receiving and rotationally supporting said insert means with sufficiently low friction to allow sufficiently rapid relative rotation between said arrowhead and said shaft to substantially prevent windplaning of said arrow;

(c) a plurality of relatively thin, substantially spaced, circumferential, smooth surfaced, circular ridges disposed on said outer surface for making very low friction sliding contact with the inner surface of said cylindrical hole to allow said rapid relative rotation;

(d) retaining means attached to said insert means for effectuating rapid insertion of said insert into said cylindrical hole of said insert receiving means, retaining of said insert means in free rotational relationship with said insert receiving means, rapid removal of said insert from said cylindrical hole of said insert receiving means to allow rapid removal and cleaning of said ridges, and rapid reinstallation of said insert means in said cylindrical hole of said insert receiving means; and (e) means for causing said arrowhead to rapidly rotate about said axis in a second direction opposite to said first direction during flight of said arrow.

10. The archery apparatus of claim 9 wherein said arrowhead is a broad blade hunting arrowhead.

11. The archery apparatus of claim 9 wherein said arrowhead rotating means includes an offset portion of a blade of said arrowhead for producing a torque on said arrowhead in response to air through which said blade passes during flight of said arrow, tending to cause said arrowhead to rotate in said second direction.

12. The archery apparatus of claim 11 wherein the blades of said arrowhead are flat, and wherein said arrowhead rotating means includes propeller means disposed between the trailing end of said arrowhead and said insert receiving means for causing said arrowhead to rotate in said second direction in response to forces produced on said propeller means by air through which said arrowhead passes during flight of said arrow.

13. The archery apparatus of claim 9 wherein said insert means is integral with said arrowhead.

14. A method of reducing windplanning of an archery arrow, said method comprising the steps of:

(a) rotationally connecting an arrowhead to the shaft of said arrow with a very low friction rotational connection;

(b) applying torque causing said arrowhead to rapidly rotate in a first direction about a longitudinal axis of said shaft in response to force applied to an offset propelling surface attached in fixed relationship to said arrowhead by air through which said propelling surface passes during flight of said arrow; and (c) applying torque causing said shaft to rapidly rotate about said axis in a second direction opposite to said first direction in response to force applied to said fletching by air through which said fletching passes during flight of said arrow.

15. An improved arrowhead connector for rotationally connecting an arrowhead to the leading end of the shaft of an archery arrow, said arrowhead connector comprising in combination:

(a) insert means for rigid connection to said broad blade arrowhead to rotationally support said arrowhead on said leading end of said shaft, said insert means having an outer surface;

(b) insert receiving means rigidly attached to said leading end of said shaft and having a cylindrical hole therein for receiving and rotationally supporting said insert means with sufficiently low friction to allow sufficiently rapid relative rotation between said arrowhead and said shaft to substantially prevent windplaning of said arrow, said insert means having a generally cylindrical inner surface;

(c) a plurality of relativey thin, substantially spaced, circumferential, smooth surfaced, circular ridges disposed on said outer surface for making very low friction sliding contact with said cylindrical inner surface to allow said rapid relative rotation; and (d) retaining means attached to said insert means for effectuating rapid insertion of said insert into said insert receiving means, retaining of said insert means in free rotational relationship with said insert receiving means, and effectuating rapid removal of said insert from said insert receiving means to allow rapid removal and cleaning of said ridges and rapid reinstallation of said insert means in said insert receiving means, wherein said retaining means includes a stud attached to one end of said insert means, said stud having an enlarged threaded end portion and a narrowed shaft portion attached to that end of said insert means, and wherein said insert receiving means includes a threaded hole at one end thereof for receiving threads of said enlarged threaded end portion, said narrowed shaft portion being sufficiently long that said enlarged threaded end portion can be threaded entirely through said threaded hole so that then said insert means rotates freely relative to said insert receiving means.

* * * * *